US005098193A

United States Patent [19]

Christensesn et al.

[11] Patent Number: 5,098,193

[45] Date of Patent: Mar. 24, 1992

[54] SPRAY CAN MIXING APPARATUS

[76] Inventors: Steven C. Christensen; Deanne L. Christensen, both of 176 Willard Ave., Pocatello, Id. 83201

[21] Appl. No.: 622,623

[22] Filed: Dec. 5, 1990

[51] Int. Cl.[5] ..... B01F 9/00

[52] U.S. Cl. ..... 366/130; 279/46 R; 279/102; 366/200; 366/213; 366/605

[58] Field of Search ..... 366/605, 342, 343, 279, 366/129, 130, 220, 199, 200, 202; 279/46 R, 102, 1 R; 15/38, 141.1, 141.2; 211/181; 248/175, 107; 408/241 R

[56] References Cited

U.S. PATENT DOCUMENTS 572,336 12/1896 Dawson ..... 211/181

2,725,931 12/1955 Snell ..... 248/107

2,912,200 11/1959 Reinhorn ..... 248/107

4,422,770 12/1983 Geible ..... 366/279

*Primary Examiner*—Robert W. Jenkins

*Attorney, Agent, or Firm*—Leon Gilden

[57] ABSTRACT

A mixing apparatus comprising a wire coil body defining a cylinder of revolution, with a cylindrical central cavity. The wire coil body includes a wire lower end portion coaxially aligned with the cylindrical central cavity and extending underlying the wire coil body for securement within a chuck portion of a rotary drill. A modification of the invention includes tubing members mounted along the wire coil body to enhance grasping of an associated spray can in a rotary mixing procedure.

3 Claims, 4 Drawing Sheets

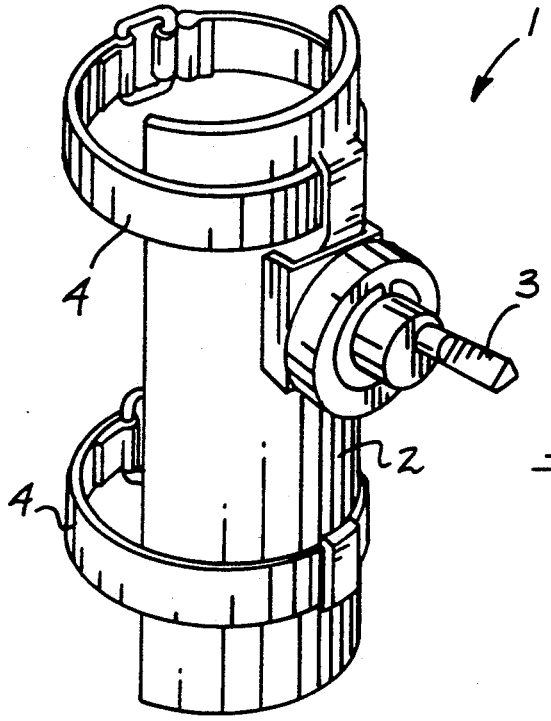
Fig 1
PRIOR ART
Fig 2
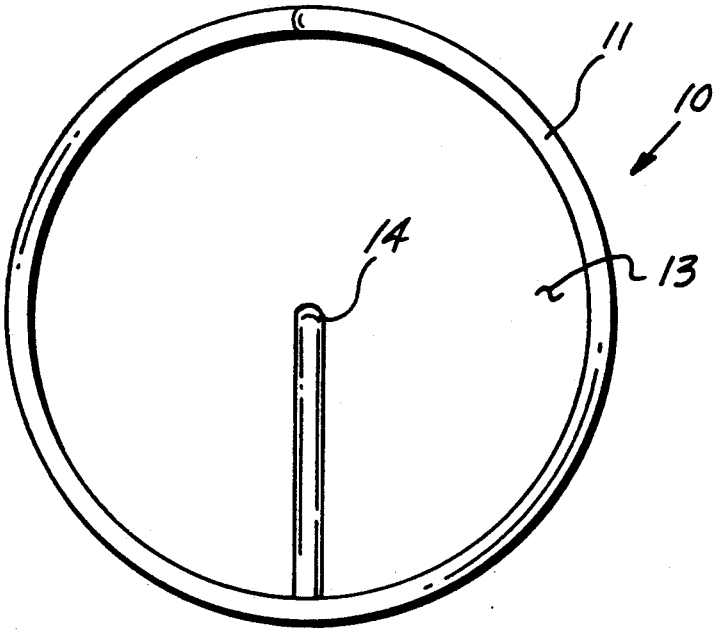

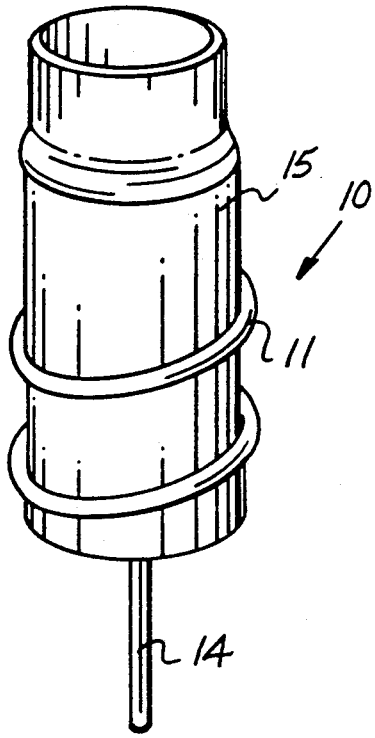
Fig 3
Fig 4
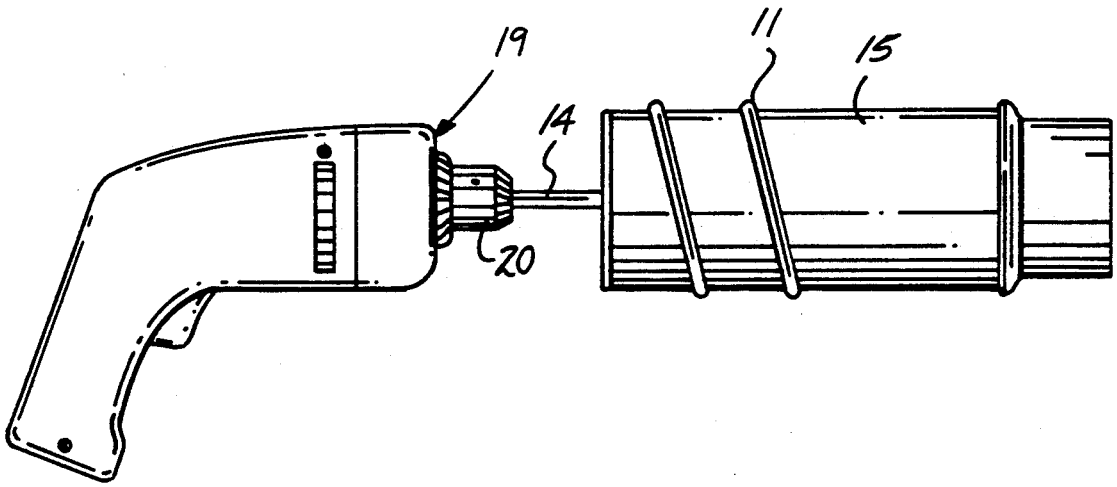

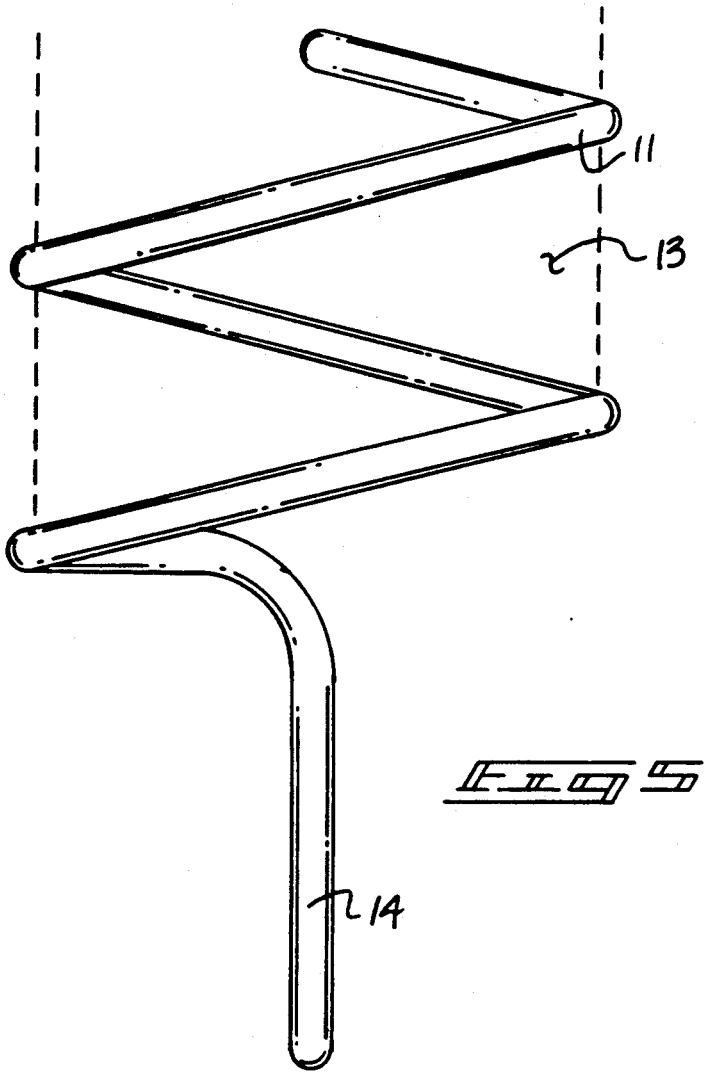
Fig 5
Fig 6
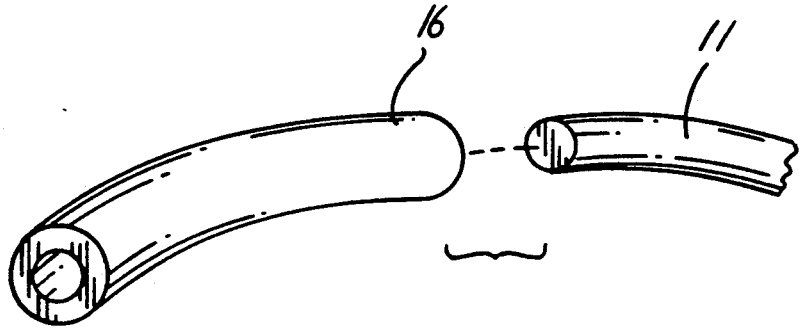

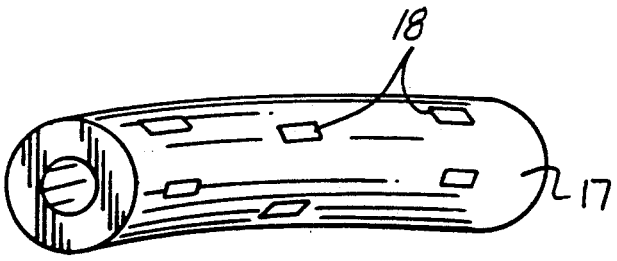
Fig 7
Fig 8
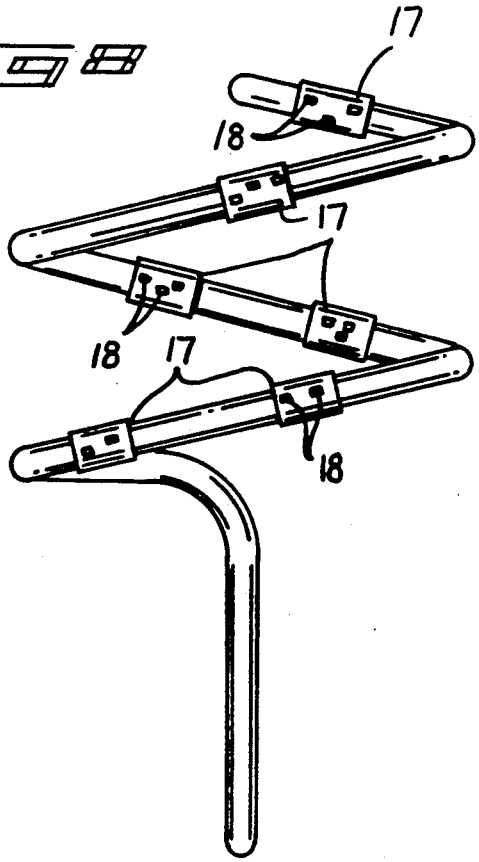

SPRAY CAN MIXING APPARATUS

BACKGROUND OF THE INVENTION

1. Field of the Invention

The field of invention relates to fluid mixing apparatus, and more particularly pertains to a new and improved spray can mixing apparatus wherein the same utilizes a frictionally engaging wire coil body to secure a spray can therewith for rotation of the spray can in a mixing procedure.

2. Description of the Prior Art

Conventional spray cans of various types, during transport and storage, effect a settling of fluid contents therewithin. Mixing of the contents requires extensive shaking and the like of the spray can. To enhance ease of use of such spray cans, the instant invention attempts to overcome deficiencies of the prior art by providing a spray can mixing apparatus easily mounting and securing a spray can therewithin for rotative mixing of a can utilizing a rotary drill member. Examples of prior art mixing apparatus may be found in U.S. Pat. No. 4,420,262 to Sterrenberg wherein a semi-cylindrical plate mounts a spray can thereon utilizing a drive shaft orthogonally oriented relative to a cylindrical axis defined by the plate to rotate the plate and associated spray can mounted therewithin.

U.S. Pat. No. 4,641,974 to Church sets forth an aerosol can agitator organization utilizing a paddle-like device mounted within the spray can to enhance manual distribution of contents within the can during a shaking procedure.

U.S. Pat. No. 3,061,280 to Kraft, et al. sets forth a mixing apparatus utilizing a motor driven support mount to secure and oscillate a can member mounted therewithin.

U.S. Pat. No. 3,128,082 to Cline sets forth a shaker apparatus wherein a coil member mounts a chuck portion therewithin at an upper end thereof, wherein the chuck mounts a container to be agitated therewithin by use of a motor member to effectively compress and release the coil in use.

U.S. Pat. No. 3,330,537 to Wason sets forth a clamp member mounted to a bottom surface of a sander to secure the container thereon and effect its agitation to enhance mixing of contents within the container.

As such, it may be appreciated that there continues to be a need for a new and improved spray can mixing apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of spray can mixing apparatus now present in the prior art, the present invention provides a spray can mixing apparatus wherein the same mounts a spray can for rotation of the spray can coaxially about its axial center for effecting agitation of the contents of the spray can. As such, the general purpose of the present invention, which will be described subsequently in greater detail, is to provide a new and improved spray can mixing apparatus which has all the advantages of the prior art spray can mixing apparatus and none of the disadvantages.

To attain this, the present invention provides a mixing apparatus comprising a wire coil body defining a cylinder of revolution, with a cylindrical central cavity. The wire coil body includes a wire lower end portion coaxially aligned with the cylindrical central cavity and extending underlying the wire coil body for securement within a chuck portion of a rotary drill. A modification of the invention includes tubing members mounted along the wire coil body to enhance grasping of an associated spray can in a rotary mixing procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved spray can mixing apparatus which has all the advantages of the prior art spray can mixing apparatus and none of the disadvantages.

It is another object of the present invention to provide a new and improved spray can mixing apparatus which may be easily and efficiently manufactured and marketed.

It is a further object of the present invention to provide a new and improved spray can mixing apparatus which is of a durable and reliable construction.

An even further object of the present invention is to provide a new and improved spray can mixing apparatus which is susceptible of a low cost of manufacture with regard to both materials and labor, and which accordingly is then susceptible of low prices of sale to the consuming public, thereby making such spray can mixing apparatus economically available to the buying public.

Still yet another object of the present invention is to provide a new and improved spray can mixing apparatus which provides in the apparatuses and methods of the prior art some of the advantages thereof, while simultaneously overcoming some of the disadvantages normally associated therewith.

Still another object of the present invention is to provide a new and improved spray can mixing apparatus wherein the same secures and rotates a spray can about its axial center line to effect rotation of the spray can about its axial center to enhance ease of securement of a rotary drill during a mixing procedure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art aerosol spray can mixing apparatus.

FIG. 2 is an orthographic top view of the spray can mixing apparatus of the instant invention.

FIG. 3 is an isometric illustration of the instant invention mounting a spray can therewithin.

FIG. 4 is an orthographic side view, taken in elevation of the invention, mounted to an associated drill for rotative mixing of the spray can member.

FIG. 5 is an orthographic side view, taken in elevation, of the instant invention.

FIG. 6 is an isometric illustration of a typical tubing member utilized by the instant invention to enhance grasping of the spray can.

FIG. 7 is an isometric illustration of a modified tubing member utilized by the instant invention.

FIG. 8 is an orthographic side view, taken in elevation, of the tubing member as utilized in cooperation with the wire coil body of the instant invention.

DESCRIPTION OF THE PREFERRED EMBODIMENT

With reference now to the drawings, and in particular to FIGS. 1 to 8 thereof, a new and improved spray can mixing apparatus embodying the principles and concepts of the present invention and generally designated by the reference numeral 10 will be described.

FIG. 1 illustrates a prior art spray can mixing apparatus 1, wherein a semi-cylindrical plate 2 mounts a spray can therewithin secured to the plate by a plurality of spaced bands 4. A drive shaft rod 3 is mounted relative to the plate to effect agitation of the plate for mixing of an associated spray can mounted therewithin.

More specifically, the spray can mixing apparatus 10 of the instant invention essentially comprises an elongate wire coil body 11 defining a cylinder of revolution therewithin and formed of a single wire member. The wire member is formed of a deformable memory retentent material to maintain frictional clamping of a spray can member 15 that is mounted therewithin, in a manner as illustrated in FIG. 3. The wire coil body 11 defines a cylindrical central cavity 13, with a wire lower end portion 14 of the single wire member projecting underlying the wire coil body 11 and coaxially aligned with the cylindrical central cavity 13. The wire lower end portion 14 is thereby mountable and secured within a drill chuck 20 of an associated drill member 19 to permit rotation of the wire coil body 11 and associated spray can 15 to effect agitation of the spray can and mixing of fluid contents therewithin.

To enhance grasping of the spray can member 15 within the cylindrical central cavity 13, a plurality of flexible, polymeric tubing members 16 are positionable along the wire coil body at spaced intervals to enhance frictional grasping of the spray can and minimize danger of release of the spray can member during use. Further, a modified plurality of tubing members 17 (see FIG. 8) are utilized, wherein the tubing members 17 utilize a matrix of ferro-magnetic plates 18 mounted and imbedded within the tubing members 17 and arranged flush with an exterior surface of each of the tubing members to enhance grasping of the spray can 15 therewithin by use of frictional, as well as ferromagnetic attraction.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A spray can mixing apparatus comprising, in combination, a wire coil body, the wire coil body formed of a single wire member and formed of a deformable memory retentent material, and the wire coil body defining a cylindrical central cavity, and a wire lower end portion of the wire coil body extends underlying the wire coil body and is coaxially aligned with the cylindrical opening cavity, and including a drill member, the drill member including a drill chuck, and the drill chuck secured to the wire lower end portion to effect selective rotation of the wire coil body.

2. An apparatus as set forth in claim 1 wherein the wire coil body includes a plurality of flexible, polymeric tubing members mounted on the wire coil body at spaced intervals along the wire coil body.

3. An apparatus as set forth in claim 2 wherein each of the tubing members includes a matrix of ferro-magnetic plates embedded within an exterior surface of each of the tubing members, and each of the ferro-magnetic plates mounted in a coextensive aligned relationship with the exterior surface of each of the tubing members.

* * * * *